US008474875B2

(12) United States Patent
Ross et al.

(10) Patent No.: US 8,474,875 B2
(45) Date of Patent: Jul. 2, 2013

(54) REPEATER FOR WIRED PIPE

(75) Inventors: Michael O. Ross, Needville, TX (US); Michael C. Sakach, Sugar Land, TX (US)

(73) Assignee: Intelliserv, LLC, Houston, TX (US)

( * ) Notice: Subject to any disclaimer, the term of this patent is extended or adjusted under 35 U.S.C. 154(b) by 599 days.

(21) Appl. No.: 12/597,653

(22) PCT Filed: Jun. 4, 2008

(86) PCT No.: PCT/US2008/065770

§ 371 (c)(1), (2), (4) Date: Mar. 11, 2010

(87) PCT Pub. No.: WO2008/154250

PCT Pub. Date: Dec. 18, 2008

(65) Prior Publication Data

US 2011/0048692 A1 Mar. 3, 2011

Related U.S. Application Data

(60) Provisional application No. 60/942,863, filed on Jun. 8, 2007.

(51) Int. Cl.
*F16L 11/12* (2006.01)
*H01R 4/64* (2006.01)

(52) U.S. Cl.
USPC ..... 285/48; 285/93; 285/333; 439/194; 439/192

(58) Field of Classification Search
USPC ..... 285/93, 48, 333; 439/194, 191, 192
See application file for complete search history.

(56) References Cited

U.S. PATENT DOCUMENTS

| | | | | | |
|---|---|---|---|---|---|
| 2,301,783 | A * | 11/1942 | Lee | 439/191 |
| 3,696,332 | A * | 10/1972 | Dickson et al. | 439/194 |
| 4,220,381 | A * | 9/1980 | van der Graaf | 439/194 |
| 4,496,203 | A * | 1/1985 | Meadows | 439/194 |
| 4,557,538 | A * | 12/1985 | Chevalier | 439/194 |
| 4,806,115 | A * | 2/1989 | Chevalier et al. | 439/194 |
| 5,334,801 | A * | 8/1994 | Mohn | 439/191 |
| 5,927,402 | A * | 7/1999 | Benson et al. | 439/194 |
| 6,123,561 | A * | 9/2000 | Turner et al. | 439/194 |
| 7,114,970 | B2 * | 10/2006 | Head | 439/191 |
| 7,193,526 | B2 | 3/2007 | Hall | |
| 7,226,090 | B2 * | 6/2007 | Hughes | 439/194 |
| 7,857,644 | B2 * | 12/2010 | Madhavan et al. | 439/191 |

* cited by examiner

*Primary Examiner* — David E Bochna
(74) *Attorney, Agent, or Firm* — Conley Rose, P.C.

(57) ABSTRACT

A wired drill pipe electronic device includes a housing having a threaded connection at each end configured to couple to a wired drill pipe having double shoulder threaded connections. A chassis is disposed inside the housing and is configured to define at least one sealed atmospheric chamber between the chassis and the housing. The chassis defines an internal passage therethrough. The device includes a stress coupling to enable transmission of at least one of axial and torque loading from both the inner and outer shoulder of adjacent wired drill pipe segments through the housing.

15 Claims, 8 Drawing Sheets

REPEATER FOR WIRED PIPE

CROSS REFERENCE TO RELATED APPLICATIONS

This application claims priority to U.S. Provisional Application Ser. No. 60/942,863, filed on Jun. 8, 2007 entitled "TELEMETRY SYSTEM REPEATER."

BACKGROUND OF THE DISCLOSURE

The invention relates generally to the field of pipe used to convey instruments along wellbores drilled through the Earth's subsurface. More particularly, the invention relates to structures for repeaters used in "wired" drill pipe systems.

Rotary drilling systems known in the art for drilling wellbores through subsurface Earth formations typically use threadedly coupled segments ("joints") of pipe suspended at the Earth's surface by a drilling unit called a "rig." The pipe is used, in association with certain types of tools such as drill collars and stabilizers to operate a drill bit disposed at the longitudinal end of a "string" of such pipe joints coupled end to end. As a wellbore is drilled, and it becomes necessary to lengthen the string of pipe, additional joints of pipe are coupled to the string by threading them onto the upper (Earth's surface) end of the string of pipe. Removing the string of pipe from the wellbore, such as to replace a drill bit, requires uncoupling joints or "stands" (segments consisting of two, three or four coupled joints) of the pipe string and lifting the string from the wellbore. Such coupling and uncoupling operations are an ordinary and necessary part of drilling a wellbore using a rig and such pipe strings ("drill strings").

It is known in the art to include various types of measuring devices near the lower end of a drill string in order to measure certain physical parameters of the wellbore and the surrounding Earth formations during the drilling of the wellbore. Such instruments are configured to record signals corresponding to the measured parameters in data storage devices associated with the measuring devices. The measuring and storing devices require electrical power for their operation. Typically such power is provided by batteries and/or a turbine powered electrical generator associated with the measuring devices. The turbine may be rotated by the flow of drilling fluid ("mud") that is pumped through a central passageway or conduit generally in the center of the pipes and tools making up the drill string. It is also known in the art to communicate certain signals representative of the measurements made by the devices in the wellbore to the Earth's surface at or close to the time of measurement by one or more forms of telemetry. One such form is extremely low frequency ("ELF") electromagnetic telemetry. Another is modulation of the flow of mud through the drill string to cause detectable pressure and/or flow rate variations at the Earth's surface.

The foregoing power and telemetry devices have well known limitations. There has been a longstanding need in the art of wellbore drilling to provide electrical power and a relatively high bandwidth communication channel along a drill string from the bit to the Earth's surface. Various structures have been devised to provide insulated electrical conductors in association with drill pipe to provide such power and signal channels for a drill string. Such structures are generally known as "wired" drill pipe. The features of the structures that have been developed for such insulated electrical conductor channels are related to the particular requirements for pipes used for drill strings, namely, that they must be made so as to cause as little change as possible in the ordinary handling and operation of drill pipe. As will be appreciated by those skilled in the art, such handling includes repeated threaded coupling and uncoupling. Use of the pipe string during drilling will result in application to the pipe string of torsional stress, bending stress, compressional and tensional stress, as well as extreme shock and vibration. Thus, a commercially acceptable wired drill pipe must be as far as practicable transparent to the drill operator and must be operable under the types of stresses applicable to ordinary (non-wired) drill string components.

One type of wired drill pipe is described in U.S. Patent Application Publication No. 2006/0225926 filed by Madhavan et al. and assigned to the assignee of the present invention. The wired drill pipe disclosed in the '926 publication includes a conduit for retaining wires in the wall of or affixed to the wall of a joint of drill pipe, as well as electromagnetic couplings for the wires proximate the longitudinal ends of the pipe joint. The electromagnetic couplings transfer power and signal between adjacent joints of wired drill pipe.

Irrespective of the type of wired drill pipe system used, it is desirable to include one or more signal conditioner and amplification devices called "repeaters" at selected positions along the pipe string to assure adequate signal amplitude at the Earth's surface for the signals transmitted from the devices at the lower end of the drill string, and vice versa. A repeater used with wired drill pipe is typically disposed in a short-length segment (about 3 to 10 feet or 1 to 3 meters) of drill pipe or drill collar. On example of a structure for a repeater is described in U.S. Pat. No. 7,193,526 issued to Hall et al. Design challenges for signal repeaters include that the internal diameter of the device should be at least as large as the smallest internal diameter of every other component of the drill string to avoid excessive restriction on the flow of drilling fluid through the drill string; that the bending stiffness and moment of inertia are similar to that of other components of the drill string having similar outer diameter; and that the threaded connections used are essentially identical to those used in the remainder of the drill string to maintain transparency to the drill operator.

A particular issue to be addressed with repeaters in a drill string is the type of threaded connection used in typical wired drill pipe. Such connections are known as "double shoulder" connections, examples of which are described in the Madhavan et al. publication referenced above. Typically, such double shoulder threaded connections when used with wired drill pipe include a groove or similar feature formed into the internal shoulder of the threaded coupling for retaining the communication coupling. It is desirable for the repeater to have the mechanical characteristics described above, and to be usable with typical double shoulder threaded connections, to be able to transfer some of the loading applied by the inner shoulder of the adjacent threaded connection.

There continues to be a need for improvements to structures for repeaters for wired drill pipe to increase their reliability, serviceability and ease of handling during drilling operations.

SUMMARY OF THE INVENTION

A wired drill pipe electronic device according to one aspect of the invention includes a housing having a threaded connection at each end configured to couple to a wired drill pipe having double shoulder threaded connections. A chassis is disposed inside the housing and is configured to define at least one sealed atmospheric chamber between the chassis and the housing. The chassis defines an internal passage therethrough. The device includes a stress coupling to enable transmission of at least one of axial and torque loading from both the inner and outer shoulder of adjacent wired drill pipe segments through the housing.

Other aspects and advantages of the invention will be apparent from the following description and the appended claims.

DETAILED DESCRIPTION

Figure 1:
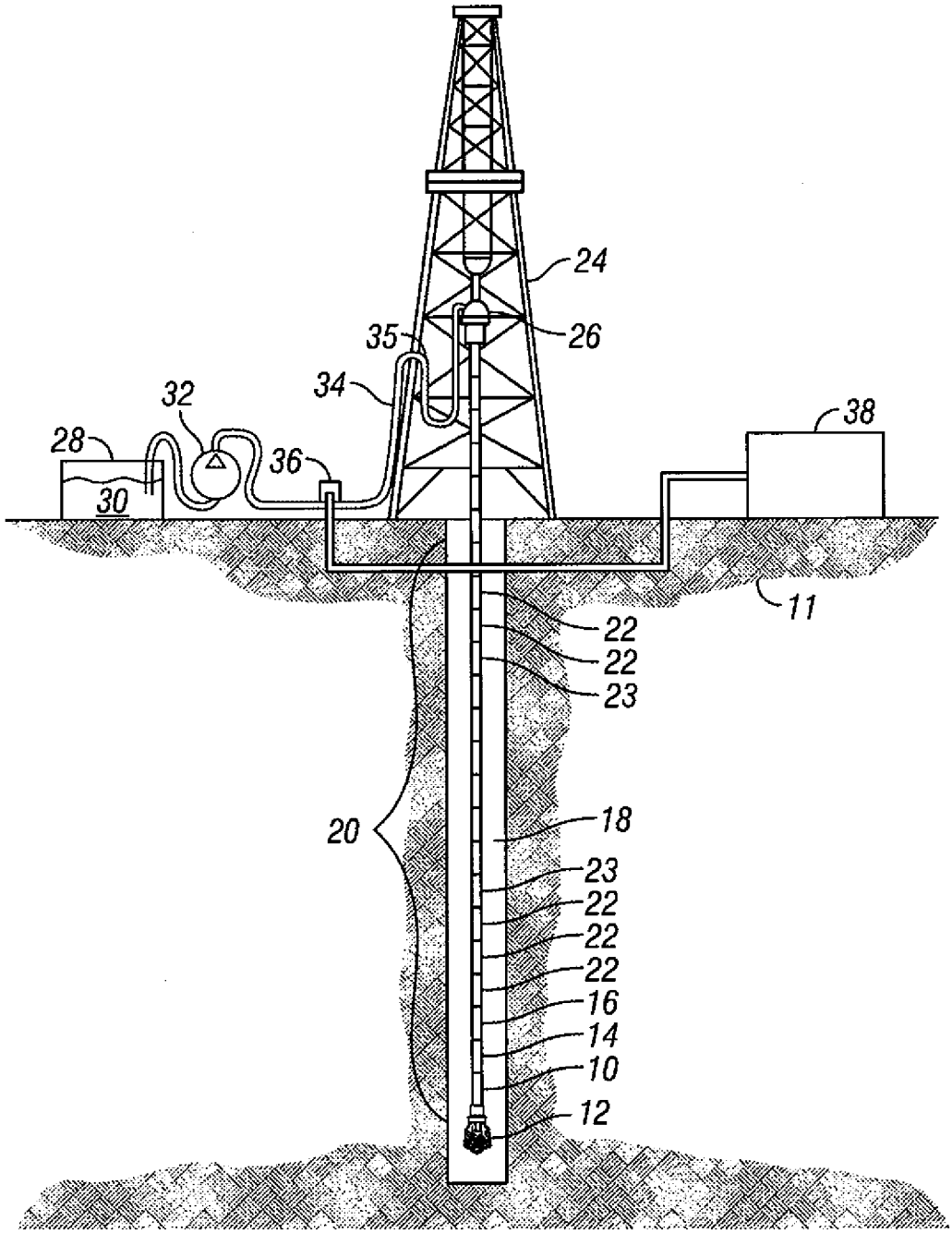
FIG. 1 shows an example drilling system using wired drill pipe and signal repeaters.

An example wellbore instrumented drilling system having wired drill pipe, with which various implementations of a repeater according to the invention may be used is shown schematically in FIG. 1. A drilling rig 24 or similar lifting device suspends a conduit called a "drill string" 20 within a wellbore 18 being drilled through subsurface rock formations, shown generally at 11. The drill string 20 may be assembled by threadedly coupling together end to end a number of segments (called "joints") 22 of drill pipe. The drill string 20 may include a drill bit 12 at its lower end. When the drill bit 12 is axially urged into the rock formations 11 at the bottom of the wellbore 18 and when it is rotated by equipment (e.g., top drive 26) on the drilling rig 24, such urging and rotation causes the bit 12 to axially extend ("deepen") the wellbore 18. The lower end of the drill string 20 may include, at a selected position above and proximate to the drill bit 12, a hydraulic motor ("mud motor") 10 that may be used to provide supplemental rotational energy to the drill bit 12 or all the rotational energy to the drill bit 12. Proximate its lower end, the drill string 20 may also include an MWD instrument 14 and an LWD instrument 16 of types well known in the art. At least part of the power to operate the MWD instrument 14 and LWD instrument 16 may be obtained from the electrical conductors (not shown in FIG. 1) associated with the wired drill string 20.

During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the drill string 20. The mud 30 exits the drill string 20 through courses or nozzles (not shown separately) in the drill bit 12, where it then cools and lubricates the drill bit 12 and lifts drill cuttings generated by the drill bit 12 to the Earth's surface. Some examples of MWD instrument 14 or LWD instrument 16 may include a telemetry transmitter (not shown separately) that modulates the flow of the mud 30 through the drill string 20. Such modulation may cause pressure variations in the mud 30 that may be detected at the Earth's surface by a pressure transducer 36 coupled at a selected position between the outlet of the pump 32 and the top drive 26. Signals from the transducer 36, which may be electrical and/or optical signals, for example, may be conducted to a recording unit 38 for decoding and interpretation using techniques well known in the art. The decoded signals typically correspond to measurements made by one or more of the sensors (not shown) in the MWD instrument 14 and/or the LWD 16 instrument. Signals from the MWD and/or LWD instruments may also be communicated along the one or more electrical conductors (not shown in FIG. 1) associated with the drill string 20.

It will be appreciated by those skilled in the art that the top drive 26 may be substituted in other examples by a swivel, kelly, kelly bushing and rotary table (none shown in FIG. 1) for rotating the drill string 20 while providing a pressure sealed passage through the drill string 20 for the mud 30. Accordingly, the invention is not limited in scope to use with top drive drilling systems.

In the example shown in FIG. 1, at selected positions along the drill string a repeater 23 may be provided. Each repeater 23 may contain circuits to amplify and condition signals originating from one direction along the conductors (not shown in FIG. 1) in the wired drill pipe and to transmit the amplified and conditioned signals in the other direction. By using such repeaters, it is possible to extend the length of the drill string 20 substantially while maintaining good signal communication in both directions.

Figure 2:
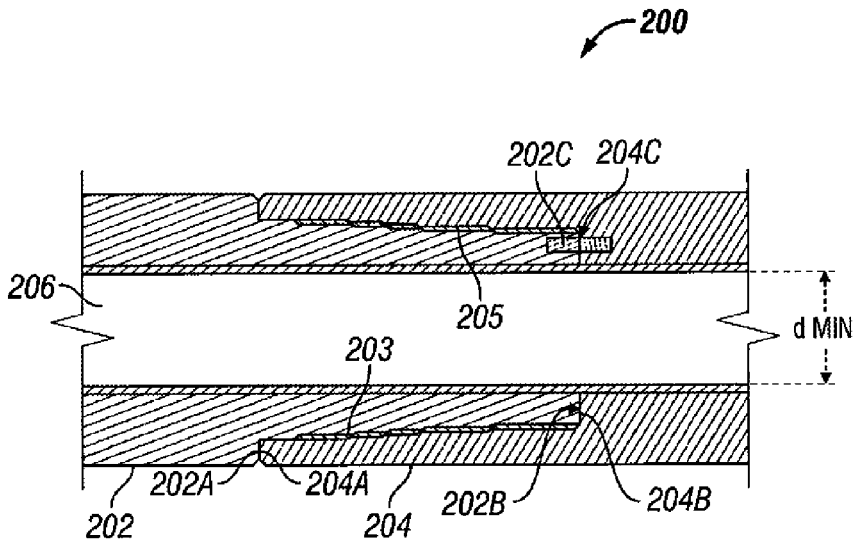
FIG. 2 (Prior Art)
FIG. 2 shows an example of a double shoulder threaded connection used in typical drill string components.

As explained in the Background section herein, one type of "wired" drill pipe is described in U.S. Patent Application Publication No. 2006/0225926 filed by Madhavan et al. and assigned to the assignee of the present invention. The wired drill pipe disclosed in the '926 publication includes a conduit for retaining wires in the wall of or affixed to the interior wall of each joint of drill pipe, as well as electromagnetic couplings for the wires proximate the longitudinal ends of each pipe joint. The couplings between the segments of pipe used in the wired drill pipe include an electromagnetic transducer disposed in a groove formed in a longitudinal end of each pipe segment. The pipe segments typically include a female ("box") connector at one longitudinal end, and a male ("pin") connector at the other longitudinal end. The type of threaded connection used is known in the art as a "double shoulder connection." The threads on the pin and the box are tapered, meaning that the external diameter of the threads changes along the length of the connection. The tip or "nose" of the pin includes a substantially planar face or shoulder on the inner diameter of the connection ("inner shoulder") that mates with a corresponding planar face or shoulder in the internal end ("base") of the box. Correspondingly, at the base of the pin a second shoulder is formed on the outer diameter of the connection ("outer shoulder") that mates with a corresponding shoulder at the end of the box on the adjacent connector. A typical threaded connection used with wired drill pipe is shown in FIG. 2 at 200. The pin is shown at 202, and the tapered thread on the pin is shown at 203. The box is shown at 204, and its tapered thread is shown at 205. The inner shoulder at the pin end is shown at 202B. The corresponding inner shoulder at the base of the box is shown at 204B. A groove is formed in each of the pin inner shoulder 202B and corresponding box inner shoulder 204B to receive a communication coupling, such as an electromagnetic transducer (not shown). The respective grooves in the pin shoulder 202B and the box shoulder 204B are shown at 202C and 204C. The external or outer shoulder is shown on the pin at 202A and on the box at 204A. The double shoulder connection shown in FIG. 2 provides metal to metal sealing of one pipe segment to the adjacent segments and efficiently transfers both torque and axial loading between each pipe segment and the adjacent pipe segments. Notwithstanding the grooves formed in the inner shoulders for the communication couplings, at least some load is transferred from each pipe segment to the adjacent segments through the inner shoulder. The inner shoulders can also provide additional metal to metal sealing to seal drilling fluid under pressure inside the internal bore 206. The threaded connection 200 defines an internal bore 206 for passage of drilling fluid therethrough. The threaded connection 200 is typically designed such that a minimum internal diameter $d_{min}$ within the connection 200 is at least as large as the minimum internal diameter of every other portion of the drill string (20 in FIG. 1).

Generally, a wired drill pipe electronic device according to various aspects of the invention includes a housing having a threaded connection at each end configured to couple to a wired drill pipe having double shoulder threaded connections. A chassis is disposed inside the housing and is configured to define at least one sealed atmospheric chamber between the chassis and the housing. The chassis defines an internal passage therethrough. The device includes a stress coupling to enable transmission of at least one of axial and torque loading from both the inner and outer shoulders of adjacent wired drill pipe segments through the housing. The device may include a communication coupling disposed adjacent to a corresponding communication coupling in the inner shoulder of each adjacent pipe segment to provide signal communication to devices disposed in the at least one atmospheric chamber.

Figure 3:
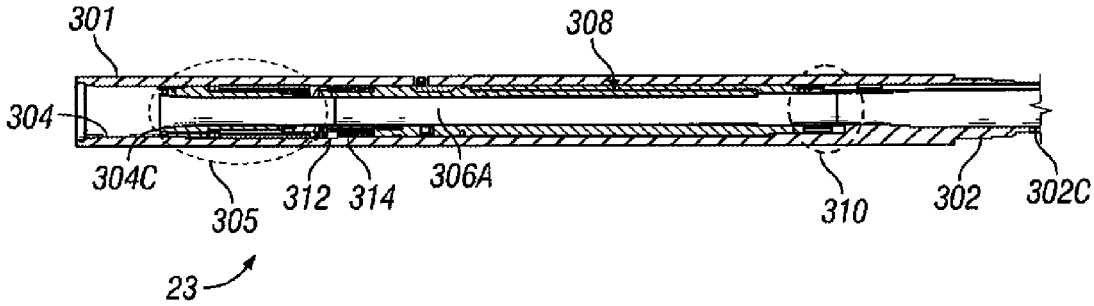
FIG. 3 shows one example of a structure for a repeater.

An example structure for a wired drill pipe electronic device such as a repeater is shown in FIG. 3 at 23. The structure shown in FIG. 3 is configured to couple in the drill string (20 in FIG. 1) between two segments of wired drill pipe or drill collars each having a double shoulder connection and a groove for a communication device disposed in the inner shoulder thereof, such as the pin and box shown in FIG. 2. The electronic device structure described herein will be referred to for convenience as a "repeater" because that is one of the intended purposes for the structure. However, the described structure may be used with other electronic devices disposed in sealed enclosures that are intended to be used with wired drill pipe having double shoulder connections. Accordingly, the use of the term "repeater" is not intended to limit the types of electronic devices that may be included in the structure or to limit the scope of the present invention. The repeater 23 may include a housing 301 formed from steel, or high strength non magnetic alloy such as stainless steel, monel or an alloy sold under the trademark INCONEL, which is a registered trademark of Huntington Alloys Corporation, Huntington, W. Va. The housing 301 may include a double shoulder male threaded connector or pin 302 at one longitudinal end configured substantially as explained above with reference to FIG. 2, including a groove 302C for receiving a communication coupling (not shown) for a wired drill pipe system. The structure of the pin 302 will be further explained with reference to FIG. 9. The structure for the groove and communication coupling may be, for example, substantially as described in the Madhavan et al. publication referenced above. It will be apparent to those skilled in the art that the pin 302 will transmit stress from the housing 301 to an adjacent coupled pipe segment (not shown) through both the outer shoulder and the inner shoulder. It should also be understood that the pin 302 could be substituted by a double shoulder box connection in alternative examples.

The other longitudinal end of the housing 301 may define a female connector or box 304. The box 304 is configured to receive a corresponding pin (not shown) of an adjacent segment (not shown) of wired drill pipe, and therefore includes tapered internal threads similar to those shown at 205 in FIG. 2. However, the box 304 does not terminate in an internal shoulder at the base thereof as does the conventional box shown in FIG. 2.

The internal bore of the housing 301 on the box end in the present example is enlarged beyond that of a similar diameter segment of double shoulder drill pipe or drill collar to receive an electronic chassis 308. The chassis 308 may be generally cylindrical in configuration and can define an internal bore 306A having diameter at least as large as the smallest internal bore (e.g., at 206 in FIG. 2) of all the other components of the wired drill pipe string (20 in FIG. 1). The outer diameter of the chassis 308 is selected to fit within the internal bore of the housing 301 through the box 304. The internal bore of the housing 301 may be enlarged to receive the chassis 308 from the box end approximately to a longitudinal position of a connector assembly 310 that makes sealed electrical and/or optical connection to a conductor (not shown) that extends from the connector assembly 310 into the groove 302C in the internal shoulder of the pin 302. The exterior of the chassis 308 may be sealed against the interior wall of the housing 301 at selected longitudinal positions to provide a sealed enclosure for electronic and/or electro-optical components by forming one or more recesses or pockets into the exterior wall of the chassis 308. An example sealing device for the chassis 308 will be explained below with reference to FIG. 8. The connector assembly 310 and a longitudinal stop shoulder to limit longitudinal movement of the chassis 308 inside the housing 301 will be further explained with reference to FIG. 9.

The chassis 308 may be longitudinally retained within the housing 301 by, for example, a jam nut 312 that threadedly engages the interior wall of the housing 301. Axial bias loading may be provided by including one or more springs 314 between the jam nut 312 and the longitudinal end of the chassis 308.

In the present example, the function of a "stress coupling" referred to above is performed by a removable inner shoulder assembly 305 is disposed in the housing 301 between the box 304 and the jam nut 312. The purposes of the removable inner shoulder assembly 305 are to transmit torque and axial loading from the nose of the pin (e.g., as shown at 202B in FIG. 2) in the adjacent pipe segment (not shown), to provide a groove to receive a communication coupling (not shown) to mate with the corresponding communication coupling in the inner shoulder of adjacent pipe segment, to make electrical and/or optical connection to certain components in the chassis 308, and to enable longitudinal removal of the chassis 308 from the housing 301 through the box end for servicing as required.

Figure 4:
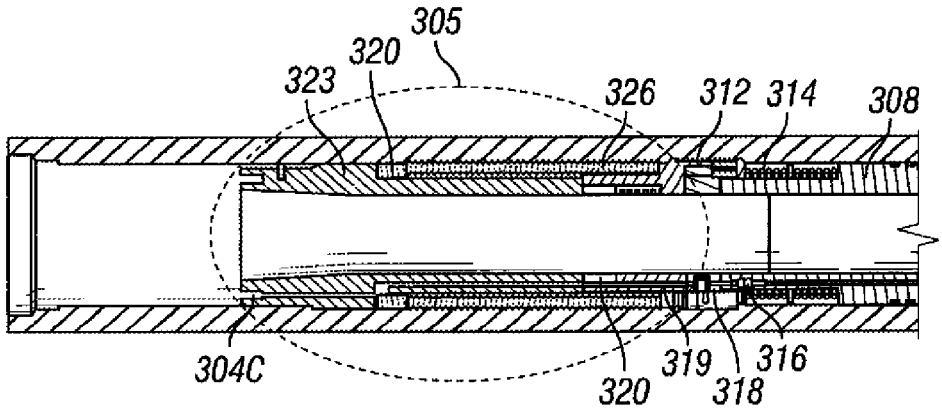
FIG. 4 shows more detail of a removable second shoulder adjacent to an electronic chassis from the example repeater shown in FIG. 3.

FIG. 4 shows the removable inner shoulder assembly 305 in more detail. The assembly 305 includes a carrier 323 having an inner shoulder with a groove therein for a communication coupling, shown generally at 304C, for mating to the inner shoulder of the adjacent pipe segment. Electrical and/or optical connection may be made between the groove 304C and the chassis through suitable passages sealed using a bulkhead feedthrough connector 316 on the chassis 308 and a boot type connector 318 affixed thereto from the carrier 323. Longitudinal position of the carrier 323 with respect to the chassis 308 may be selected by the use of suitable shims 320. The foregoing connectors may be disposed in a separate connector carrier 319. The carrier 323 may communicate torque and/or axial loading from the shoulder 304C to the housing a segmented locking device 326 to be explained further below.

Figure 5:
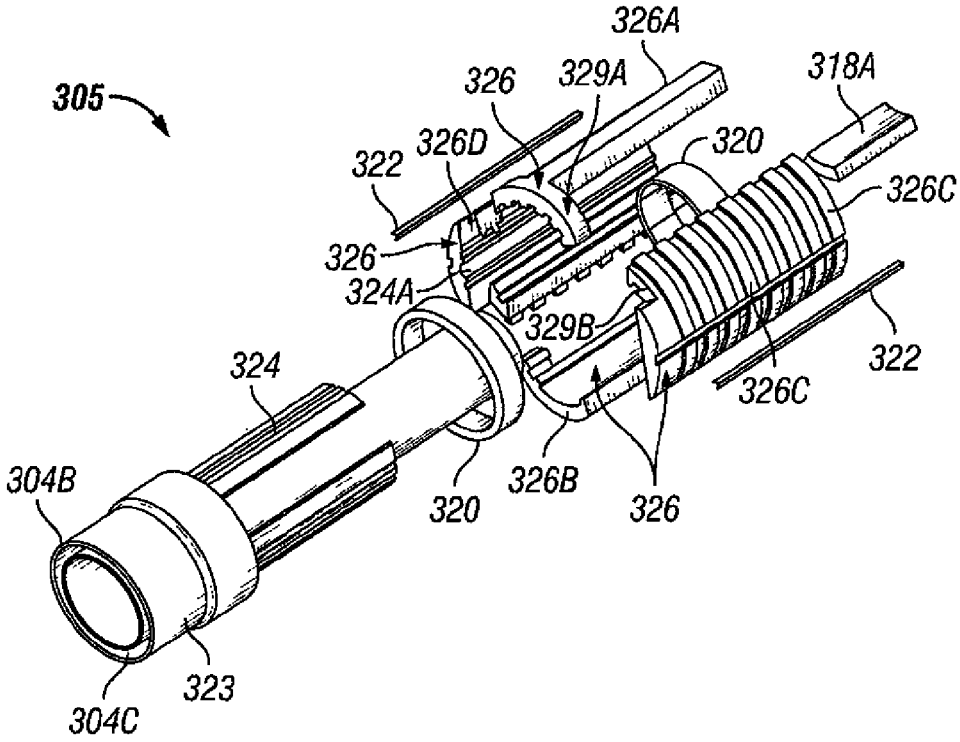
FIG. 5 shows an exploded view of the removable second shoulder assembly shown in FIG. 4.

FIG. 5 shows an exploded view of the removable inner shoulder assembly 305. The carrier 323, which may be formed from steel or other high strength alloy as explained above with reference to the housing 301, includes an inner shoulder 304B to mate with the corresponding inner shoulder on the pin of the adjacent pipe segment (e.g., 202 in FIG. 2) The shoulder 304B may include the previously mentioned groove 304C for receiving a wired drill pipe communication coupling (not shown). The carrier 323 may include splines 324 formed on a portion of the outer diameter of the carrier 323 to transmit torque loads to other components of the removable inner shoulder assembly 305. Such other components may include four circumferential locking elements (which when assembled form the locking device 326 in FIG. 4), including two "side" locking elements 326C, 326D which are identical, and "upper" 326A and "lower" 326B locking elements. Reference to "upper", "lower" and "side" with respect to the locking elements is made only for purposes of identification in the accompanying drawings and has no relationship to the actual position of the locking elements.

The two side elements 326C, 326D may have a longitudinally extending keyway (not shown) for receiving a key 322, which prevents rotation of the assembly 305 in the housing (301 in FIG. 3). The housing (301 in FIG. 3) has a mating keyway as will be explained below with reference to FIG. 6. The top 326A and bottom 326B elements may extend laterally into a mating slot (not shown) formed in the interior surface of the housing (301 in FIG. 3) to further resist rotation. Multiple radial grooves 326E may be formed in the exterior face of the side locking elements 326C, 326D to transmit axial load from the mating pin connection (e.g., 202 in FIG. 2) to the housing (301 in FIG. 3). Each of the upper 326A and lower 326B locking elements may include circumferential extensions 329A that extend over corresponding circumferential recesses 329B in the longitudinal ends of the side locking elements 326C, 326D.

To assemble the second shoulder assembly 305 into the housing (301 in FIG. 3), the side locking elements may be inserted into their respective retaining features (explained below with reference to FIG. 6) in the interior of the housing (301 in FIG. 3) by extending them laterally into such features. The upper 326A and lower 326B locking elements may then be inserted longitudinally into the circumferential spaces left between the circumferential ends of the side locking elements 326C, 326D. The upper 326A and lower 326B locking elements may be coupled to the side elements 326C, 326D through the extensions 329A using cap screws (not shown) or the like. The locking elements are thus longitudinally and laterally retained within the housing (301 in FIG. 3). The carrier 323 may then be inserted into the locking elements. To position the carrier 323 longitudinally precisely, shims 320 may be inserted onto the exterior of the carrier 323.

Figure 6:
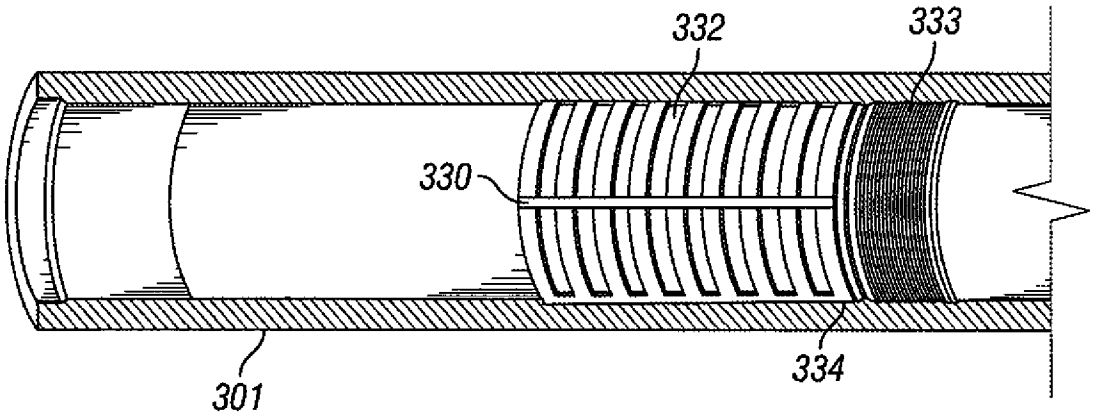
FIG. 6 shows an example interior wall configuration for a housing for the repeater shown in FIG. 3.

FIG. 6 shows an example of features formed into the interior wall of the housing 301 to retain the locking elements (FIG. 5) within the housing 301. The features may include axially spaced apart, circumferential grooves 332 to mate with corresponding grooves (326E in FIG. 5) on the exterior of the locking elements. The grooves 332 cooperate with the grooves (326E in FIG. 5) on the locking elements to transmit axial loading from the mating pin (202 in FIG. 2) to the housing 301. A keyway 330 may also be formed longitudinally to receive the keys (322 in FIG. 5) to assist in transmitting torque to the housing 301.

Figure 7:
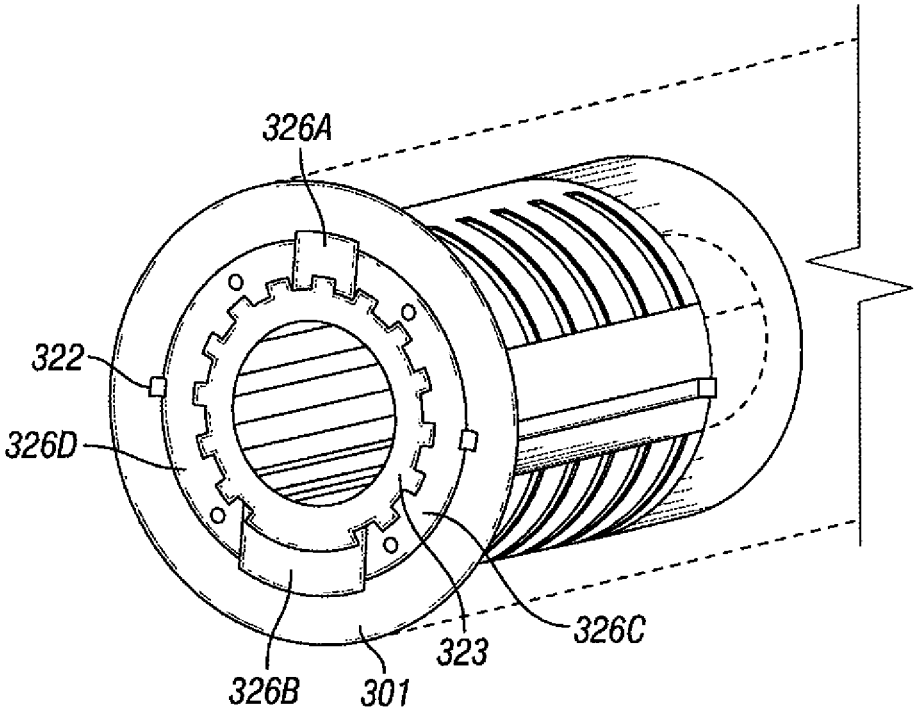
FIG. 7 shows a portion of the assembly of FIG. 5 coupled to the interior of the housing.

An oblique view of the assembled locking elements 326A, 326B, 326C, 326D, keys 322 and carrier is shown in FIG. 7 to explain the respective locations of the foregoing when assembled.

There are two sets of shims 320 used in the assembly. Referring once again to FIG. 5, some of the shims are used for length adjustment and are built up to an exact thickness as needed to position the carrier 323 inner shoulder face 304B at an exact distance relative to the box connection face. The other shims 320 can be used for connector adjustment to position the connector carrier (319 in FIG. 4) at the proper location for mating the connectors (316, 318 in FIG. 4). The connector carrier (319 in FIG. 4) can be a separate piece that contains two rubber booted connectors that mate with fluid-to-air connectors (bulkhead connectors) mounted in the end of the chassis (308 in FIG. 4). The connectors can be wired to the wired drill pipe communication coupling disposed in the groove 304C in the end of the carrier 323. The shims 320 can also be used to adjust the inner shoulder assembly as needed for shortening of the housing 301 due to occasional rethreading.

Figure 8:
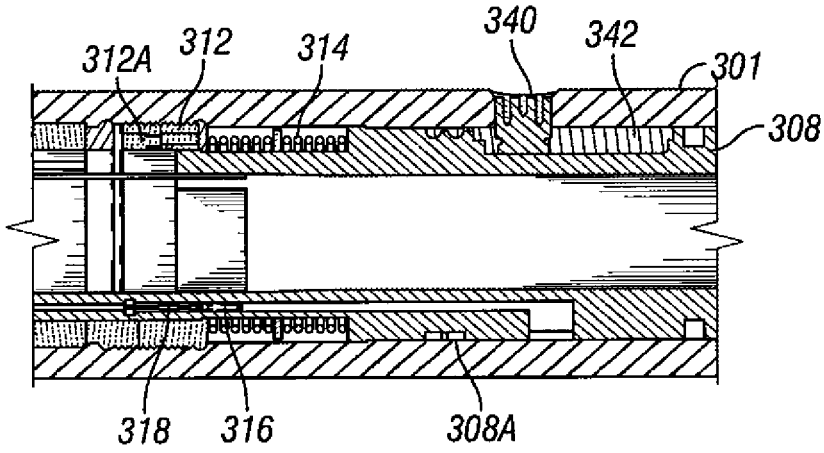
FIG. 8 shows an example sealed electrical and/or optical connection between the chassis and the shoulder assembly.

Referring to FIG. 8, the jam nut 312 may be a multi-segment jam nut assembled within the housing, and which may have overlapping surfaces that bolt together with screws 312A to form a single assembly, in a manner similar to the locking elements explained with reference to FIG. 5. The jam nut 312 is used to hold the chassis 308 securely in place against a shoulder (350 in FIG. 9) in the housing 301. The jam nut 312 can be tightened against a spring 314 which is compressed against the chassis 308 holding it in place against the shoulder (350 in FIG. 9).

There may be a T-shaped or other geometry locking groove 342 formed in the exterior of the chassis 308 beneath an alignment pin 340. The locking groove 342 traps the alignment pin 340 to keep it from coming out of the groove 342. The groove 342 in the chassis 308 allows the alignment pin 340 to be inserted through a hole in the wall of the housing 301 prior to entering the groove 342. The groove 342 and alignment pin 340 allow the chassis 308 to be moved longitudinally against the shoulder (350 in FIG. 9) while maintaining rotational alignment of the chassis 308 within the housing 301. The chassis 308 may be sealed against the interior of the housing 301 using o-rings 308A or similar sealing device. The chassis 308, as explained above may be formed to define one or more chambers (not shown in FIG. 8) between its exterior and the interior wall of the housing 301, such that when sealingly engaged to the interior of the housing 301, such chamber(s) (not shown) provide sealed, atmospheric pressure enclosures for the various electronic and/or electro-optical devices (not shown) disposed in the chassis 308.

Figure 9:
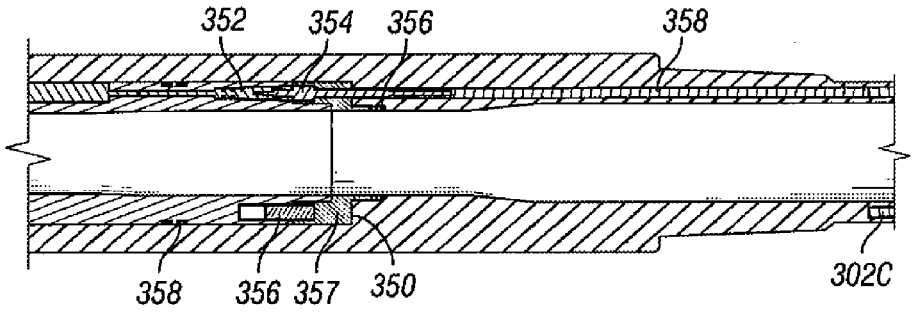
FIG. 9 shows an example connection between one end of the electronic chassis and a pin end of the repeater.

Referring to FIG. 9, a bulkhead-type or pressure sealing feedthrough connector 352 is mounted in a suitable opening in the longitudinal end of the chassis 308 that is to be in contact with the shoulder 350. The bulkhead connector 352 mates with a corresponding bulkhead connector 354 mounted in a connector ring 357. The connector ring 357 and connector 354 are initially installed and electrically connected (e.g., with wires and/or optical fibers) to the wired drill pipe communication connector (not shown) in the groove 302C of the pin through a gun drilled hole 358. The gun drilled hole 358 extending into the groove 302C is conventional construction for wired drill pipe and may be configured, for example, as described in the Madhavan et al. publication referenced above. The ring/connector assembly locks into place, for example, by using an o-ring 356 that is disposed in both a groove in the connector ring 357 and a mating groove in the housing 301. The bulkhead connector 354 and connector ring assembly 357 remains in the housing 301 after installation even if the chassis 308 is removed. While the lock pin in the chassis (see 340 in FIG. 8) helps to align the chassis 308 with the ring/connector assembly 357, an additional alignment pin 356 may be used between the chassis 308 and ring/connector assembly 357 to ensure proper alignment of the connectors 352, 354 during assembly.

Although, male/female "stab" type connectors are illustrated for use in the removable shoulder assembly (e.g., 318, 316 in FIG. 8) and at the bottom of the chassis as the interface with the connector ring making electrical contact with the wired drill pipe communication sensor in the pin connection (e.g., 325, 354 in FIG. 9) radial or ring type connectors could be utilized here as well to remove the requirement for angular alignment between the associated mechanical parts. An example of this type of connector assembly will be explained below with reference to FIG. 15.

Figure 10:
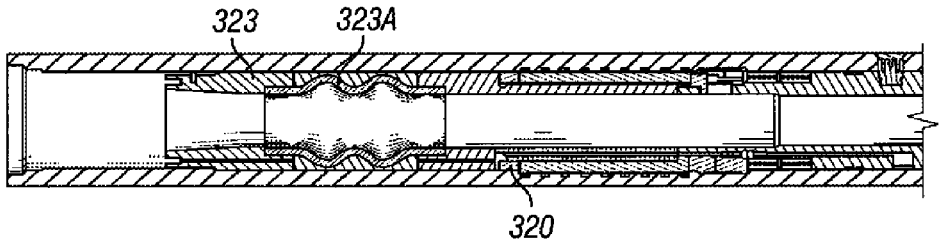
FIG. 10 shows another example of a removable second shoulder assembly.

Another example of a repeater does not require precise location of the secondary shoulder face on the carrier to the outer/primary sealing face of the box connection on the housing. Referring to FIG. 10, such example provides the carrier 323 of the previous example split into two pieces with an extremely stiff spring element 323A. The pin nose of the mating pipe segment (e.g., 202 in FIG. 2) will push against the carrier secondary sealing face, thus compressing the spring element 323A. Once the threaded connection is assembled, the preload of the very stiff spring element 323A will generate a similar axial force on the secondary sealing faces as would be obtained from threading a conventional pipe connection (e.g., FIG. 2) together. Shims may be used to obtain a particular compression range. A compression range is desirable to control the amount of preload on the thread shoulders after threading the connection together. The shims could also be used to adjust for variations in the housing length due to rethreading. The rest of the removable secondary shoulder assembly and chassis assembly can be essentially as described above with reference to FIGS. 3 through 7.

A different example design of the repeater assembly will now be explained with reference to FIG. 11. The example repeater shown at 23A in FIG. 11 uses a housing 301 having a female threaded connection (box) at each longitudinal end and a chassis 308 assembled inside the housing from two discrete sections. The two chassis sections (FIG. 12) may each be inserted into the housing 301 from a respective longitudinal end of the housing 301. Each longitudinal end of the housing 301 may have a single shoulder box connection 304 to mate with a pin end of a corresponding "pony sub" 360. Each pony sub 360 includes on one longitudinal end thereof a double shoulder pin end configured substantially as shown in and as explained with reference to FIG. 2. The double shoulder connection end of each pony sub 360 is configured to mate with an adjacent pipe segment in the drill string (20 in FIG. 1). Each pony sub includes on such longitudinal end a groove for receiving a communication coupling, also as explained with reference to FIG. 2.

The other longitudinal end of each pony sub 360 may include a double shoulder pin (male) threaded connection configured to engage the box connection at the corresponding end of the housing 301. When engaged into the housing 301, the end of the pin compresses and traps the respective end of the chassis section against an internal shoulder formed into the interior wall of the housing 301. The foregoing structure can be used at both longitudinal ends of the housing 301 to lock the respective chassis sections in place inside the housing 301, and to transfer at least axial loading from the inner shoulder on each pony sub pin to the housing 301. Thus, in the present example the pony subs 360 perform the function of the stress coupling described above. There can be a slip joint between the chassis sections where they overlap to sealingly, slidably engage each other. The example shown in FIG. 11 includes a pin connection on the end of each pony sub 360 that couples to the repeater assembly. The pony subs 360 may include either a double shoulder box connection or a double shoulder pin connection on the end that couples to the drill string (20 in FIG. 1).

Figure 11:
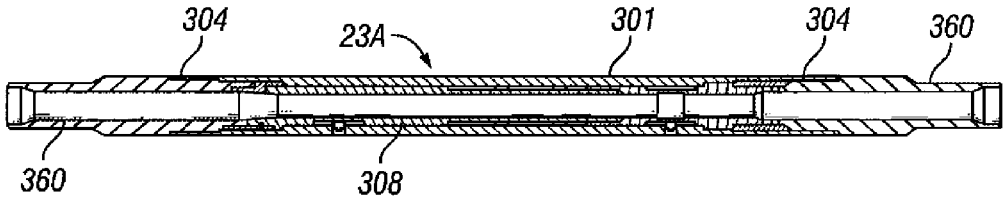
FIG. 11 shows a different example of a repeater structure having box connections at each end.
Figure 12:
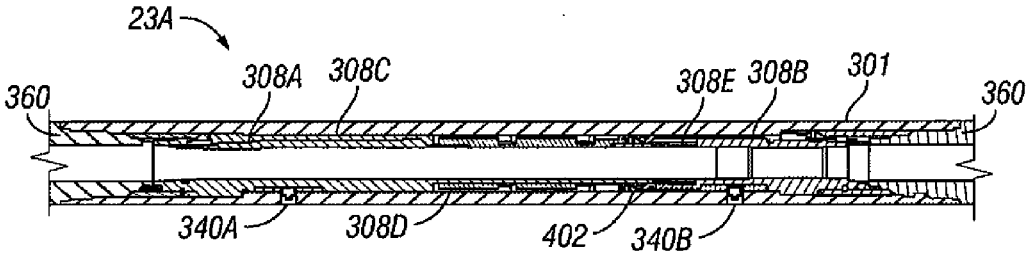
FIG. 12 shows the example of FIG. 11 in more detail.

The example shown in FIG. 11 is shown in additional detail in FIG. 12. The chassis 308 is shown as being assembled from an "upper" chassis section 308A and a lower chassis section 308B coupled to each other inside the housing by a sealing slip joint 308E. Recesses in the exterior surface of the chassis 308 may include provisions for batteries 308D and electronic circuit assemblies or boards 308C. Electrical and/or optical connections between components in the upper chassis section 308A and the lower chassis section 308B may be made using a radial connector assembly 402. Each chassis section 308A, 308B may be held in place rotationally by a respective alignment pin 340A, 340B substantially as explained above with reference to FIG. 8.

Figure 13:
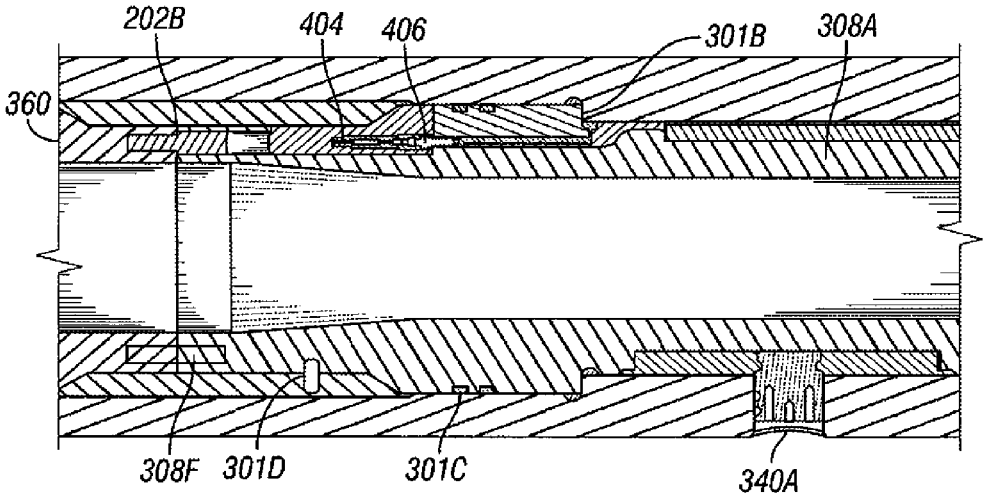
FIG. 13 shows more detail of a removable shoulder assembly of the repeater of FIG. 12.

In the present example, the second shoulder for the pipe threaded connection is provided by part of the chassis 308. Referring to FIG. 13, a wired drill pipe communication coupling (not shown) may be mounted in a groove 308F formed in the end of each electronics chassis section, e.g., 308A in FIG. 13. The present example includes an internal shoulder 301B formed into the interior wall of the housing 301 to transfer axial load from the inner shoulder of the mating pipe pin connection (e.g., pony sub 360 in FIG. 11). The axial load is transmitted through the longitudinal end of the chassis section (e.g., 308A) to the internal shoulder 301B. The arrangement shown in FIG. 13 also serves to lock and hold each of the chassis sections (308A, 308B in FIG. 12) in place longitudinally within the housing 301. The shoulder 301B is possible in the present example by making the outer diameter of the housing 301 larger than that used in a corresponding size drill string component. The female thread connection at each end of the housing 301 is thus different than that used on the standard drill pipes and collars. Therefore, the pony collars 360 may include a pin thread to mate with the larger, non-standard size female thread in each end of the housing 301, but the opposite end of each pony sub 360 may have a standard size double shoulder thread for the size drill pipe or drill collars used in the drill string (20 in FIG. 1). In other examples, it is possible to provide some radial wall thickness for the shoulder 301B by reducing the taper of the housing thread (that mates to the pony sub 360) or using thread having no taper (straight thread). Using reduced taper thread or straight thread does not require an increase of the external diameter of the housing 301. The use of pony subs on each end of the housing as shown in FIG. 11 enables the use of any selected type of thread to join the pony subs to the housing, with the standard double shoulder thread on the opposite end of each pony sub enables the repeater to couple with any of the other sections of the pipe string.

The housing 301 may be a short sub with a length range of 3-20 feet (1-6 meters) and the pony subs 360 on each end of the housing 301 may have a length selected so that the overall length of the repeater 23A is about 30 feet (10 meters), which is a standard length for pipe segments. Having a repeater that is the same length as standard pipe segments may make handling on the drilling rig easier.

Figure 14:
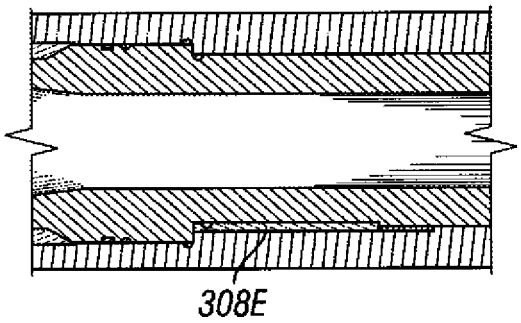
FIG. 14 shows an alignment key used to prevent relative rotation.

Two keyways may be machined through the shoulders 301B in the housing. Keys (308E in FIG. 14) located on the chassis sections (308A, 308B in FIG. 12) may engage these keyways during insertion of the chassis sections so that the chassis sections can resist torque during mating of the pony collars (360 in FIG. 12) to the housing 301. There may be one or two bulkhead connectors 406 mounted in a cavity near the longitudinal end of each chassis section. Conductors from the connectors 406 extend to appropriate terminals on electronics circuit boards (not shown separately) mounted on the chassis section. Rubber booted connectors 404 that mate with the bulkhead connectors 406 can be wired to the wired drill pipe communication coupling mounted in the groove 308F of the second shoulder formed in the chassis end. The rubber booted connector 404 and bulkhead connector 406 when mated form a sealed connector assembly that can be exposed to high pressure fluid without electrical or optical loss, and prevents entry of fluid into the interior of the chassis. The shoulder end of the chassis may include o-rings 301C or similar device to seal the chassis inside the housing 301. The features described herein may be substantially the same for both ends of the repeater.

Figure 15:
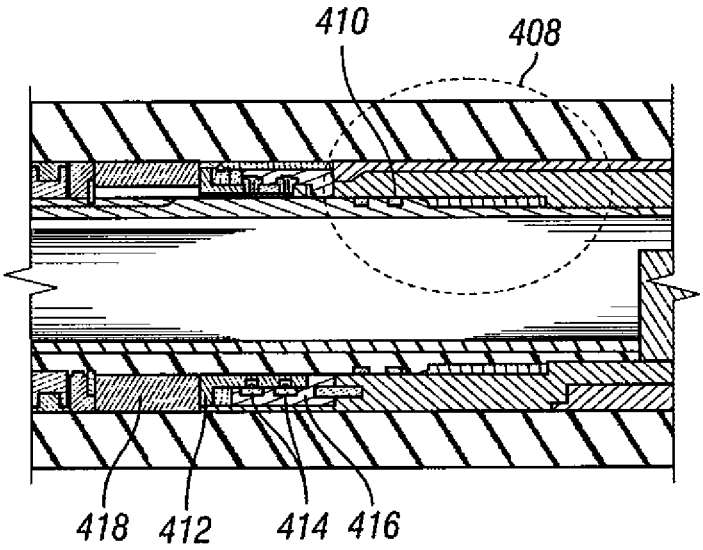
FIG. 15 shows an example of a radial electrical and/or optical connection.

Referring to FIG. 15, o-rings or similar seals 410 are located in the slip joint 408 seal the chassis as assembled from pressurized fluid in the mod flow passage in the chassis from entering the one or more sealed chambers defined by the chassis. A radial/ring conductor electrical or optical connector, shown at 412 and 416 may be provided at the slip joint 408 to connect conductors in both sections of the chassis together. Contact surfaces 414 may have sufficient longitudinal dimension to allow some relative movement between the two chassis sections due to thermal and pressure effects. The radial contact configuration can eliminate the requirement to have precise rotational (angular) alignment between each chassis section. However, the two chassis sections could use an alignment feature at the slip joint 408 if desired to rotationally align the two chassis sections, allowing the use of "stab" type connectors, e.g. the connectors shown at 352 and 354 in FIG. 9. The connectors on one side of the slip joint 408 are preferably spring loaded to keep the connector sets mated notwithstanding changes in length. As in previous examples explained above, electronic and/or electro-optical circuit boards may be mounted into pockets formed into the exterior surface of the chassis.

Assembly of the pony subs (360 in FIG. 11) to each end of the housing may be performed under controlled conditions to minimize the potential for damage to box connections on the housing (301 in FIG. 11). In the event that there is damage to the box thread or shoulder in the housing, it is possible to rework the box or shoulder areas. As the distance from the box face to the shoulder is precisely selected, during rework the box end and shoulder must be correspondingly reworked to maintain the distance. There is provision in the present example for rework length in each end of the housing. To maintain the proper relationship between the two radial/ring connector sections, there are a series of shims 418 disposed on one side of the connector 412 which enables proper positioning after rework.

In the event that the chassis face is damaged, or the wired drill pipe communication coupling has to be changed, some extra length may be added to each end of the chassis section to allow for re-machining. The shorter distance of the chassis end face to the small shoulder would require either that the box thread connection be reworked to shorten the distance of the box face to the small shoulder by the same amount or shims will have to be added between the chassis shoulder and the integral shoulder in the housing 301 to account for the re-work length.

A readout port connector (ROP) can be added for connection to the electronic circuits (not shown) disposed on the chassis and for re-charging the batteries (308D in FIG. 12). If a ROP is not used, it is possible to omit the alignment pin and keys between the chassis and the housing. Omitting alignment pins and keys would allow each chassis section to rotate during make-up of the short pony pipes with the repeater sub. Rotation is permissible if the radial connector is used at the slip joint as shown in FIG. 15.

A repeater for wired drill pipe made according to the concepts exemplified herein may have increased torque and axial load handling capacity as compared to repeaters known in the art prior to the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electronic device for coupling within a wired pipe string, comprising:

a housing having a threaded connection at each end configured to couple to a wired drill pipe having double shoulder threaded connections;

a chassis disposed inside the housing and configured to define at least one sealed atmospheric chamber between the chassis and the housing, the chassis defining an internal passage therethrough;

at least one stress coupling configured to transmit at least one of axial loading and torque loading from both an inner and an outer shoulder of adjacent wired drill pipe segments through the housing; and a jam nut disposed inside the house and configured to retain the chassis inside the housing.

2. The device of claim 1 wherein the at least one stress coupling includes a feature on an inner thread shoulder for retaining a communication coupling.

3. The device of claim 1 wherein the housing defines an internal shoulder to limit axial movement therethrough of the chassis.

4. The device of claim 1 wherein the internal bore defined by the chassis has a diameter at least as large as a smallest internal diameter of any part of a double shoulder connection pipe string coupled thereto.

5. The device of claim 1 further comprising a biasing device disposed between a longitudinal end of the chassis and the jam nut.

6. An electronic device for coupling within a wired pipe string, comprising:

a housing having a threaded connection at each end configured to couple to a wired drill pipe having double shoulder threaded connections;

a chassis disposed inside the housing and configured to define at least one sealed atmospheric chamber between the chassis and the housing, the chassis defining an internal passage therethrough; and at least one stress coupling configured to transmit at least one of axial loading and torque loading from both an inner and an outer shoulder of adjacent wired drill pipe segments through the housing;

wherein a first longitudinal end of the housing includes a double shoulder threaded connection formed therein, the housing defines an internal bore from a second longitudinal end thereof having a larger diameter than a diameter of an inner shoulder of the connection on the first longitudinal end, and wherein the stress coupling comprises a removable inner shoulder assembly disposed in the second longitudinal end, the removable inner shoulder assembly configured to mate to an inner shoulder of an adjacent pipe segment having a double shoulder threaded connection.

7. The device of claim 6 wherein the removable inner shoulder assembly includes a feature in a shoulder face thereof for retaining a communication coupling.

8. The device of claim 6 wherein the removable inner shoulder assembly includes splines to transmit torque from an inner shoulder of the adjacent pipe segment to the housing.

9. The device of claim 6 further comprising shims between a thrust surface of the inner shoulder assembly and a corresponding thrust surface inside the housing, the shims having thickness selected to longitudinally align a face of the inner shoulder assembly with a mating inner shoulder of an adjacent double shoulder threaded connection.

10. The device of claim 6 wherein the removable inner shoulder assembly includes circumferential grooves to transmit axial force from an inner shoulder of the adjacent pipe segment to the housing.

11. The device of claim 6 wherein the removable inner shoulder assembly includes a spring disposed between a surface thereof configured to mate with the inner shoulder of the adjacent pipe segment and the housing, the spring having force selected so that an axial load applied to the housing by the spring is substantially the same as an axial load applied by the inner shoulder of the adjacent pipe segment to the removable inner shoulder assembly.

12. An electronic device for coupling within a wired pipe string, comprising:

a housing having a threaded connection at each end configured to couple to a wired drill pipe having double shoulder threaded connections;

a chassis disposed inside the housing and configured to define at least one sealed atmospheric chamber between the chassis and the housing, the chassis defining an internal passage therethrough; and at least one stress coupling configured to transmit at least one of axial loading and torque loading from both an inner and an outer shoulder of adjacent wired drill pipe segments through the housing; and wherein the housing defines an internal bore having a shoulder proximate each longitudinal end, wherein the chassis defines two chassis sections each insertable into the housing through one longitudinal end, wherein the chassis sections each define an external diameter feature configured to engage a respective shoulder in the internal bore in the housing, wherein the chassis sections sealingly, slidably engage each other within the internal bore, and wherein the stress coupling comprises a pony sub configured to threadedly engage both an inner shoulder and an outer shoulder of a double shoulder threaded connection at one longitudinal end, the stress coupling configured to threadedly engage the housing at the other longitudinal end and to axially compress the chassis section engaged on the respective internal shoulder in the housing.

13. The device of claim 12 wherein each pony sub comprises a groove for retaining a communication coupling in an inner shoulder thereof of the end configured to engage the double shoulder threaded connection.

14. The device of claim 12 wherein at least one of electrical and optical coupling is made between the two chassis sections using a radial connector.

15. The device of claim 12 wherein the internal bore defined by the chassis has a diameter at least as large as a smallest internal diameter of any part of a double shoulder connection pipe string coupled thereto.

* * * * *